United States Patent [19]

LaMontagne

[11] Patent Number: 4,575,370

[45] Date of Patent: Mar. 11, 1986

[54] CENTRIFUGE EMPLOYING VARIABLE HEIGHT DISCHARGE WEIR

[75] Inventor: Peter L. LaMontagne, New Britain, Pa.

[73] Assignee: Pennwalt Corporation, Philadelphia, Pa.

[21] Appl. No.: 671,540

[22] Filed: Nov. 15, 1984

[51] Int. Cl.[4] ..... B04B 1/20; B04B 3/04

[52] U.S. Cl. ..... 494/56; 494/53

[58] Field of Search ..... 494/53, 54, 58, 56, 494/37, 26, 23

[56] References Cited

U.S. PATENT DOCUMENTS

| | | | |
|---|---|---|---|
| 3,172,851 | 3/1965 | Ambler | 494/37 |
| 3,228,594 | 1/1966 | Amero | 494/23 |
| 3,623,656 | 11/1971 | Lavanchy | 494/53 |
| 3,795,361 | 3/1974 | Lee | 494/26 |
| 4,335,846 | 6/1982 | Shapiro | 494/54 |
| 4,339,072 | 7/1982 | Hiller | 494/56 |

*Primary Examiner*—Robert W. Jenkins

[57] ABSTRACT

Dam members are provided with an upper discharge weir surface permitting flow of separated liquid thereover during normal or stable centrifuge operations, and a notch or the like interrupting said weir surface or disposed immediately therebelow to provide a lower discharge weir surface permitting flow of separated liquid therethrough to insure an absence of liquid being discharged at solid discharge ports during start-up.

12 Claims, 11 Drawing Figures

CENTRIFUGE EMPLOYING VARIABLE HEIGHT DISCHARGE WEIR

STATEMENT OF THE INVENTION

This invention relates to centrifugal separators and more particularly to improved configurations of dam members employed therewith to insure an absence of liquid being discharged through the solids discharge ports during start-up operations.

BACKGROUND OF THE INVENTION

Centrifuges operating at very deep, or negative ponds, usually rely upon the solids which accumulate at the solids discharge end to hold back the liquid in the bowl to thereby prevent the liquid from pouring out through the solids discharge openings. During start-up however, when insufficient solids are present in the bowl, liquid very frequently pours out both the centrate, or liquid discharge end, and the solids discharge end.

As a consequence of liquid being discharged during start-up through the solids discharge ports, an unpleasant condition arises. More specifically, when a hauling truck, for example, is disposed below a solids discharge chute of the centrifuge in order to receive the solid discharge, but initially receives an outpouring of liquid, typically for several minutes, with a subsequent plopping of solids thereinto, the solids oftentimes comprising sewage, a modestly discomforting situation results. Additionally, the truck's contents are not considered "truckable", i.e., the liquid seeps and leaks through cracks and openings in the hauling truck creating a general, or possibly even a serious nuisance along the highway. When solids are removed by belt conveyors, as oftentimes done, liquid flowing over the conveyor edges creates similar problems.

Past attempts to correct the abovementioned problem involved the use of stationary skimmers, or pieces of metal plate adjustably secured over the hub openings, or plates which could be adjustably rotated over the hub openings wherein the plates were provided with off-centered liquid discharge holes, and the like. Each of the above had drawbacks, i.e., careful and time-consuming adjustment of the dam or dam-like members was required; or the distance between the centrifuge axis of rotation and the inner surfaces of the solids discharge ports and liquid discharge ports were critical for satisfactory operation; or the device yet failed to adequately prevent liquid from discharging through the solids discharge ports.

Still other means and methods exist for controllably discharging separated liquids from the bowl through dams or dam-like members.

For example, in U.S. Pat. No. 3,172,851, assigned to the present assignee, a process of separating solids from a liquid-solids mixture is disclosed wherein the solids comprise particles of relatively small size and having a density only slightly different from the liquid. The solids are caused to automatically form a dam of settled solids adjacent the solids discharge ports to thereby substantially block the flow of liquids therethrough.

Additional patents disclosing means for controllably discharging liquids from separated solids-liquids mixtures from centrifuges wherein dam-like members are employed include the following U.S. Pat. Nos. 3,623,656; 3,228,594; and 3,795,361.

The present invention insures that truckable solids only are discharged at the solids discharge ports of the centrifuge. To that end, the centrifuge is provided with improved dam means which is unitary, of simple construction, and is readily adjustably mounted to the hub to partially cover the hub openings. The improved dam members permit a portion of the liquid to leave the bowl at a shallower level than that level normally required to initiate flow over the dam weir, and thus substantially, if not completely, eliminating the possibility of any liquid pouring out the cake or solids discharge end, while yet permitting and controlling the level of normal liquid flow over the weir after conditions have stabilized within the centrifuge.

The improved dam means is effected by providing a notch or cut-out portion in the typically curved weir surface of the dam member, the curve substantially coinciding with the curvature of the liquid level in the rotating bowl. The weir surface however may be substantially straight to approximate the shape of the liquid surface, later described. The notch or cut-out portion, in effect, serves to increase the radial distance between the dam's lower or outer weir and the axis of rotation of the bowl to thereby permit the liquid to be discharged over the notch during start-up. Absent the notch or cut-out portion, liquid will be discharged from the solids discharge ports of a typical centrifuge, notwithstanding the supply feed rate will be reduced during start-up.

DETAILED DESCRIPTION OF THE INVENTION

Figure 1:
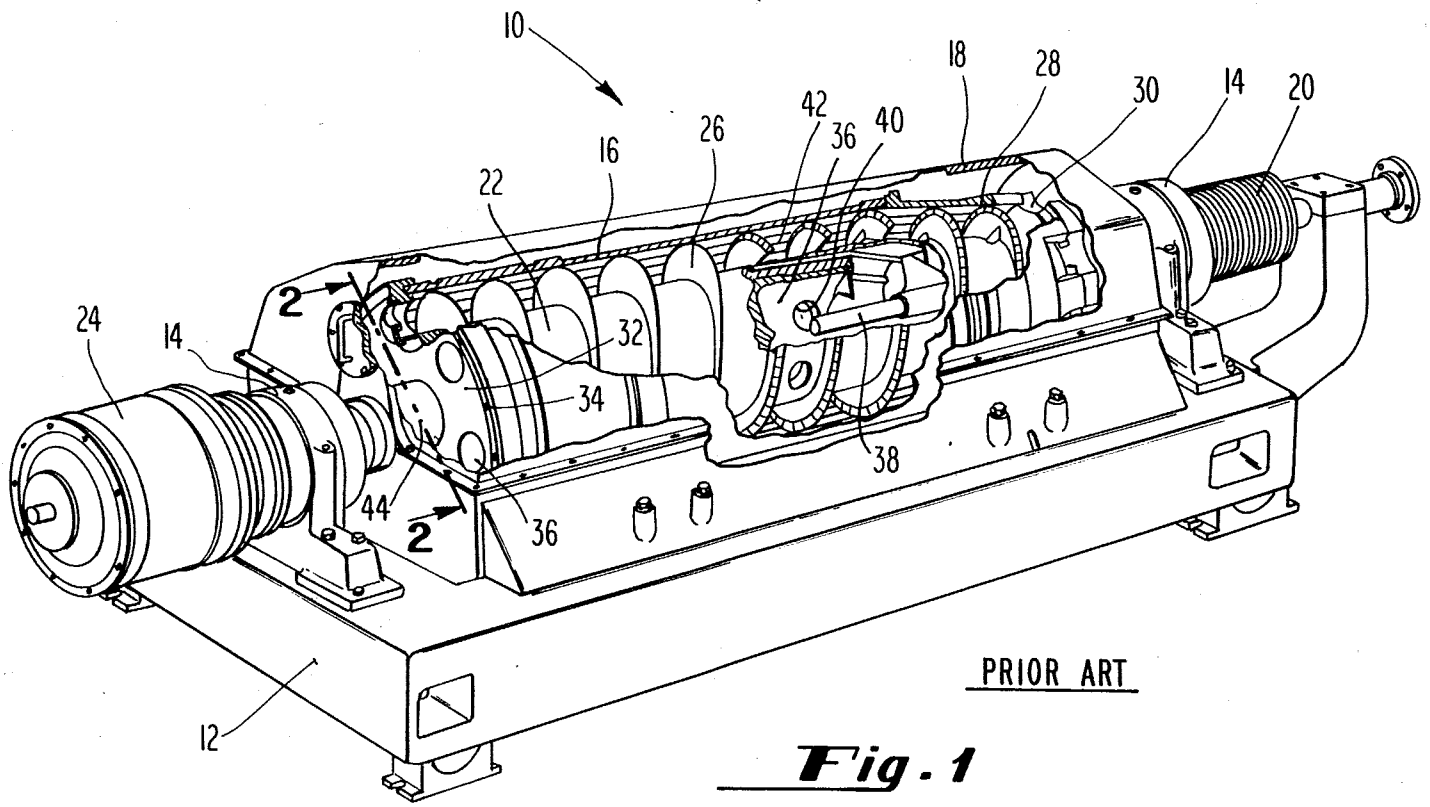
PRIOR ART Fig. 1
FIG. 1 is a perspective view, part in section, of existing centrifuge apparatus, the front hub member thereof having one of its openings cooperating with a conventional dam member.

In FIG. 1, centrifuge 10 comprises a frame 12 supporting bearings 14 into which are journaled the ends of a hollow, elongated centrifuge bowl 16 of circular cross-section. Bowl 16 rotates about its longitudinal axis within housing 18. Bowl 16 is typically belt driven by a motor (not shown), the belt extending around pulley 20. Bowl 16 rotates at speeds capable of generating a centrifugal force up to several thousand times greater than the force of gravity. Disposed within bowl 16, and mounted coaxially therewith, is a helical screw conveyor 22 adapted to rotate at a speed slightly different than that of bowl 16 by suitable means, typically gear box 24 having torque control means (not shown) and a spline shaft within the bowl shaft connected to conveyor 22. Helical screw conveyor 22 includes coiled screw flights 26, the distal edges thereof generally complementing the inside contour of bowl 16, but spaced a short distance therefrom to provide some clearance therebetween.

Bowl 16 is provided at its rearward end with a tapered or convergent portion 28, commonly referred to as the beach area. Symmetrically arranged around the beach area 26 is a group of solids discharge openings 30.

The front end of bowl 16 is provided with a hub member 32 supported within main bearing 14. Hub 32 may readily be separated from bowl 16 by simply removing bolts 34 adjacent periphery of the hub. A plurality of spaced openings 36 are provided symmetrically uniformly in hub 32 for discharge of the separated liquids therethrough into a liquids discharge duct or chamber (not shown).

Helical screw conveyor 22, being hollow, defines an area therewithin designated feed chamber 36. The process feed stream, or liquids-solids mixture to be separated, is introduced into feed chamber 36 through an axially extending feedpipe 38. The mixture is next delivered through a plurality of radial passages 40 disposed within helical screw conveyor 22 into a separation chamber 42 exteriorly conveyor 22 and interiorly bowl 16. By virtue of the controlled differential in the speeds of rotation of conveyor 22 and bowl 16, the solids are urged up the beach 28 for discharge through openings 30 while simultaneously therewith the liquids are discharged through hub openings 36.

During start-up however, as discussed above, the normal build-up of solids adjacent the solids discharge openings which tend to restrain the liquid phase from passing therethrough is absent due to an insufficient level of solids present in the bowl. To insure that liquid does not outpour from the solids discharge openings during start-up, hub openings 36 coact with improved dam members having variable height weir surfaces allowing lower levels of liquid to flow through hub openings 36 over lower weir surfaces during start-up while yet permitting and controlling separated liquid to flow in a normal manner over the dam's upper or normal weir surfaces under typical operating conditions or periods of high liquid flow.

Figure 2:
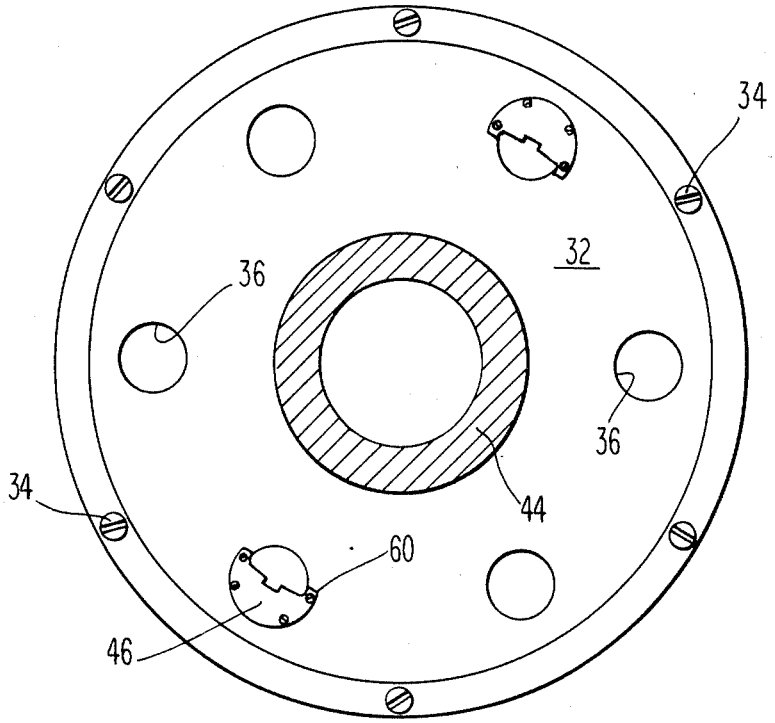
FIG. 2 is a view of the front hub member of FIG. 1 (the hub shaft shown in section), looking in the direction of arrows 2—2, omitting the conventional dam member but including several dam members of the present invention mounted in operating position.
Figure 3A:
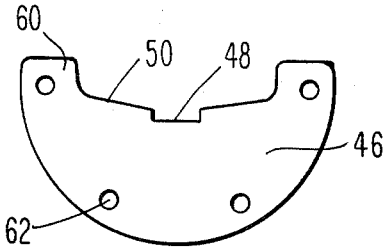
FIGS. 3A, 3B and 3C, 3D, 3E and 3F are embodiments of the dam members of the present invention.

Referring now to FIG. 2, bowl 16 and hub 32 rotate as a unit through hub shaft 44. Each opening 36 cooperates with a dam 46 (only two shown) screw mounted to hub 32, or the dam may be formed integrally with the hub. Dam 46 is provided with a rectangularly configured notch 48 (FIG. 3A) centrally disposed over typically curved weir surface 50 which substantially coincides with the level of liquid during rotation of the bowl.

Figure 3B:
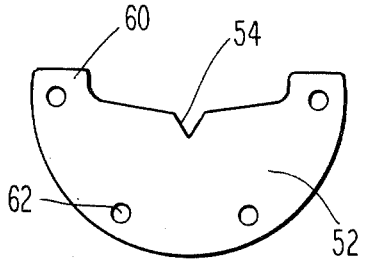
Figure 3C:
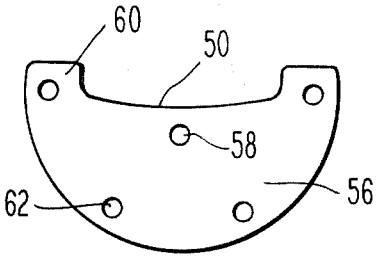
Figure 3D:
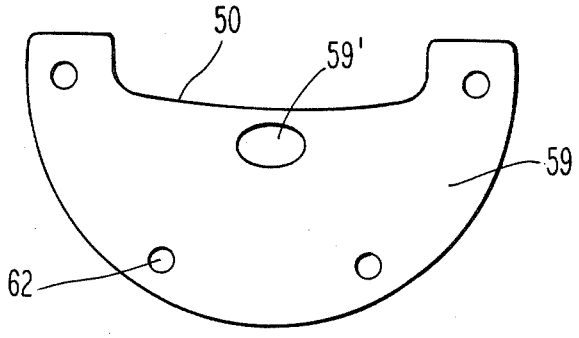
Figure 3E:
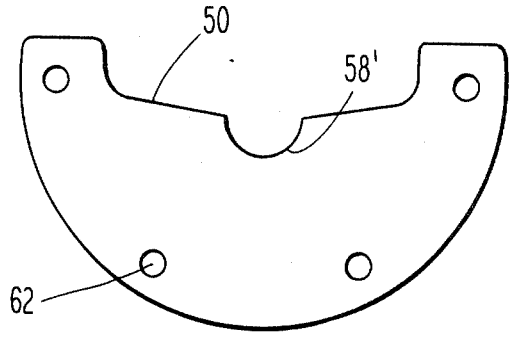
Figure 3F:
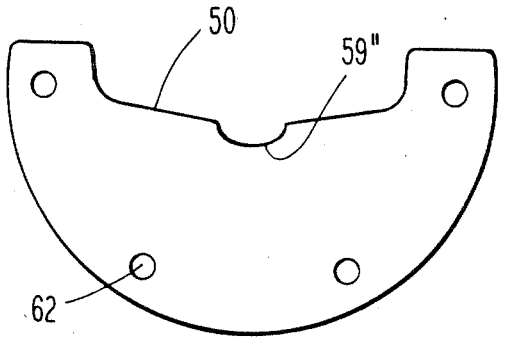

Dam 52 (FIG. 3B) is provided with a V-notch 54, while dam 56 (FIG. 3C) includes a circular opening 58 immediately below weir surface 50, while dam 59 (FIG. 3D) includes an elliptical opening 59', although openings 58 and 59' may be raised to break the continuity of weir surface 50. The centrally disposed cut-away portion may be semicircular 58' (FIG. 3E), semi-elliptical 59'' (FIG. 3F), or of any suitable configuration, it being understood that the particular shape or pattern thereof is not intended to be limited to those shown and described. Further, the dam may be provided with opposed ears 60 to facilitate threaded attachment to the hub or the ears may be abandoned in favor of a continuous curved surface 50. Spaced bolt holes 62 in the respective dam members permit the dams to be readily secured to the hub 32 in desired cooperating relationship with openings 36.

Figure 4A:
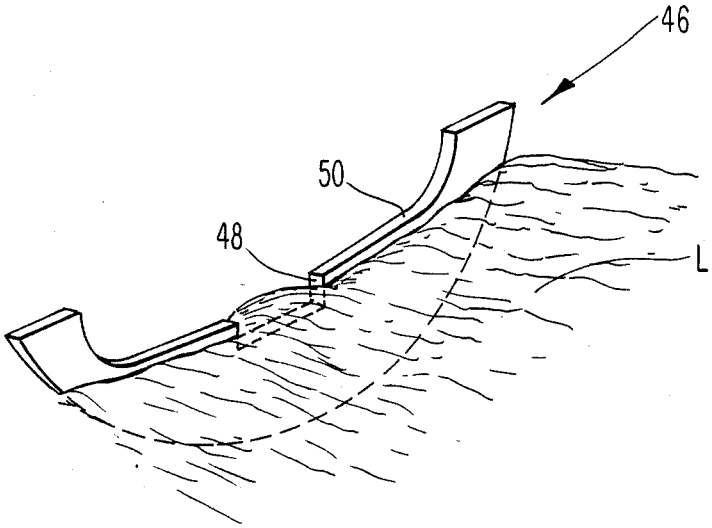
FIGS. 4A and 4B diagrammatically illustrate pool surfaces during start-up operations (low flow) and normal operation (high or normal flow) respectively.
Figure 4B:
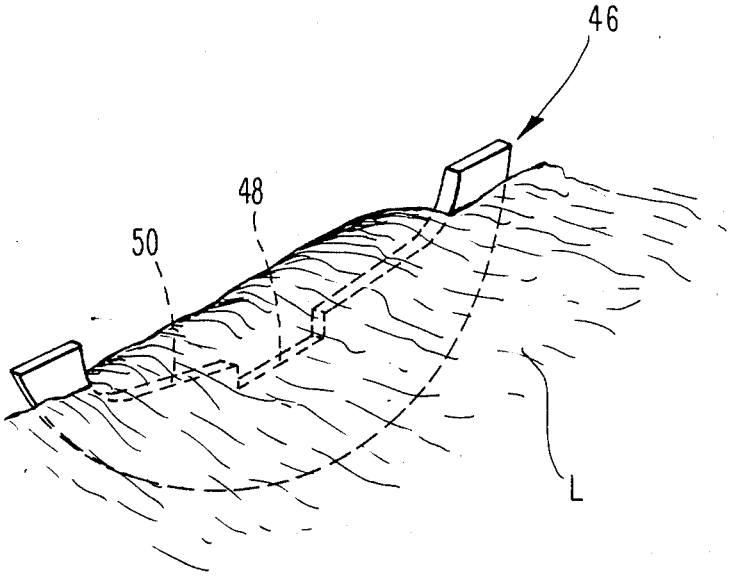

In the practice of my invention, during start-up, the operator reduces the supply feed rate such that substantially all of the centrate liquid L (FIG. 4A) flows through notch 48 since its depth is at a lower liquid level (greater radial distance from the bowl axis of rotation) than the solids discharge ports 30. Within a few minutes of operation, sufficient quantities of solids accumulate against the wall of bowl 16 and up beach 28 to form the normal build-up at the solids discharge area. The feed rate may then be brought up to normal operating range and the pond level raised to the liquid L surfaces. Effluent then discharges over normal weir surface 50 (FIG. 4B). The variable height discharge weir dam members of my invention thus prevent liquid from outpouring through the solids discharge ports during start-up by allowing centrate to flow over a lower height discharge weir portion (notch) while simultaneously automatically controlling the liquid level within the bowl by permitting centrate to flow over the upper height discharge weir portion (typically curved weir surface) during normal centrifuge operations.

Figure 5:
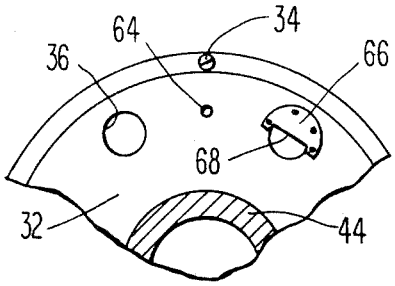
FIG. 5 is a fragmentary view of FIG. 2 illustrating a modification thereof.

Optionally, hub 32 itself may be provided with a plurality of spaced holes 64 (FIG. 5) in lieu of the notches 48, 54, or openings 58, 59', or cut-away portions 58', 59'', previously described, it being understood that holes 64 will be disposed at the same liquid level thereof. The dam members 66 will therefore require no notches, openings or cut-out portions. Dam member 66 includes a substantially straight weir surface 68, as may the other dam members of the present invention, to approximate the shape of the liquid surface.

I claim:

1. Centrifuge apparatus for separating solids from liquids from feed comprising a solids-liquids mixture fed into a bowl of said centrifuge mounted for rotation about an axis of rotation and including screw means cooperating with means for rotating said bowl for conveying said solids from said mixture for discharge out a rear portion of said bowl and liquid for discharge out a front portion of said bowl, said centrifuge having a hub at a front portion thereof mounted for rotation with said bowl, said hub having a plurality of spaced openings therethrough communicating with said fed solids-liquids mixture, the improvement to said centrifuge apparatus comprising, a dam plate secured to each of said hub openings, each of said dam plates having variable height discharge weirs provided therein, one of said weirs having a curved upper weir surface for controlling level of separated liquid within said bowl during normal or stable centrifuge operation, and other of said weirs comprising a lower cut-out portion disposed along said upper weir surface and substantially immediately therebelow for permitting separated liquid to be discharged therethrough during centrifuge start-up operations wherein said separated liquid is discharged at a lower rate than during said stable centrifuge operation.

2. Centrifuge apparatus of claim 1 wherein said discharge weir surfaces are integral with said hub.

3. Centrifuge apparatus of claim 1 wherein said upper weir surfaces form a substantially straight line approximating surface shape of said separated liquid.

4. Centrifuge apparatus of claim 1 wherein said cut-out poriton is a notch interrupting said curved weir surface.

5. Centrifuge apparatus of claim 4 wherein said notch is rectangularly configured.

6. Centrifuge apparatus of claim 4 wherein said notch is V-shaped.

7. Centrifuge apparatus of claim 1 wherein said cut-out portion is circular or elliptical.

8. Centrifuge apparatus of claim 7 wherein said circular or elliptical cut-out portion interrupts said curved weir surface.

9. Centrifuge apparatus of claim 1 wherein distance between said axis of rotation and said cut-out portion is greater than distance between said axis of rotation and said rear portion of said bowl where said solids are discharged.

10. Centrifuge apparatus of claim 1 wherein said curved upper weir surface substantially coincides with level of liquid in said rotating bowl.

11. Centrifuge apparatus for separating solids from liquids from feed comprising a solids-liquids mixture fed into a bowl of said centrifuge mounted for rotation about an axis of rotation and including screw means cooperating with means for rotating said bowl for conveying said solids from said mixture for discharge out a rear portion of said bowl and liquid for discharge out a front portion of said bowl, said centrifuge having a hub at a front portion thereof mounted for rotation with said bowl, said hub having a plurality of spaced openings therethrough communicating with said fed solids-liquids mixture, the improvement to said centrifuge apparatus comprising, a dam plate secured to each of said hub openings, each of said dam plates having discharge weir surface for controlling level of separated liquid within said bowl during normal or stable centrifuge operation, a plurality of spaced liquid discharge holes provided in said hub wherein distance between said axis of rotation and said holes is greater than distance between said axis of rotation and said rear portion of said bowl where said solids are discharged, said holes permitting said separated liquid to be discharged therethrough during centrifuge start-up operations wherein said separated liquid is discharged at a lower rate than during said stable centrifuge operation.

12. Centrifuge apparatus of claim 11 wherein said discharge weir surfaces for controlling level of separated liquid within said bowl during normal or stable centrifuge conditions are integral with said hub.

* * * * *